United States Patent [19]

Snitovski

[11] Patent Number: 4,802,318

[45] Date of Patent: Feb. 7, 1989

[54] INSULATING BLOCK UNIT, A METHOD FOR ITS MANUFACTURE, AND A METHOD OF ERECTING A WALL BY MEANS OF SUCH BLOCKS

[76] Inventor: Jacov Snitovski, 17 Bialik St., Ramat Hasharon, Israel

[21] Appl. No.: 83,034

[22] Filed: Aug. 6, 1987

[51] Int. Cl.[4] ..... L04B 5/04

[52] U.S. Cl. ..... 52/309.12; 52/309.11; 52/405; 52/562; 52/612; 29/525.1

[58] Field of Search ..... 52/747, 597, 309.11, 52/426, 405, 562, 563, 564, 612; 29/526 R

[56] References Cited

U.S. PATENT DOCUMENTS

| | | | |
|---|---|---|---|
| 3,559,361 | 2/1971 | Sarros | 52/747 |
| 3,815,733 | 1/1974 | Roberts | 52/747 |
| 4,055,928 | 11/1977 | Magerle | 52/405 |
| 4,574,550 | 3/1986 | Maschhoff | 52/405 |
| 4,584,043 | 4/1986 | Riefler | 52/747 |
| 4,616,459 | 10/1986 | Shubow | 52/747 |

FOREIGN PATENT DOCUMENTS

| | | | |
|---|---|---|---|
| 2440466 | 3/1976 | Fed. Rep. of Germany | 52/405 |
| 1375968 | 9/1964 | France | 52/426 |
| 7412425 | 9/1973 | Netherlands | 52/405 |

*Primary Examiner*—Henry E. Raduazo

*Attorney, Agent, or Firm*—Silverman, Cass, Singer & Winburn, Ltd.

[57] ABSTRACT

A thermally insulating masonry block constituted by a sandwich of at least two building blocks between which a plate of insulating material is interposed, the sandwich being tied together by at least one strap. A method of making such an insulating masonry block unit comprising the steps of interposing a plate of insulating material between two building blocks and tying the blocks and insulating plate together by at least one strap.

15 Claims, 4 Drawing Sheets

FIG. 1
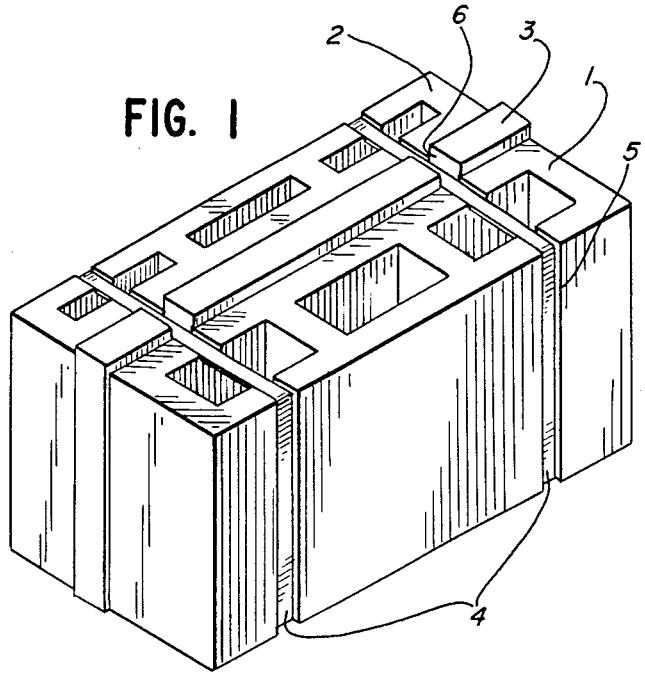
FIG. 2
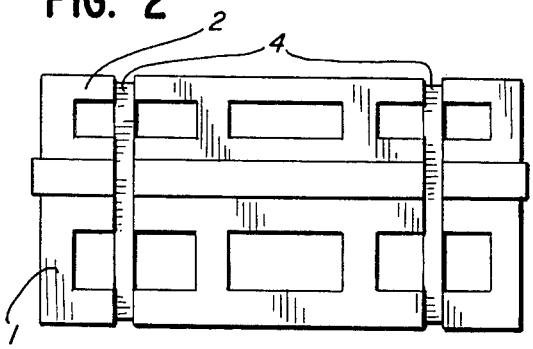
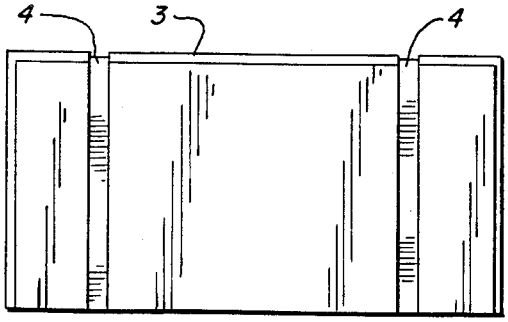
FIG. 3
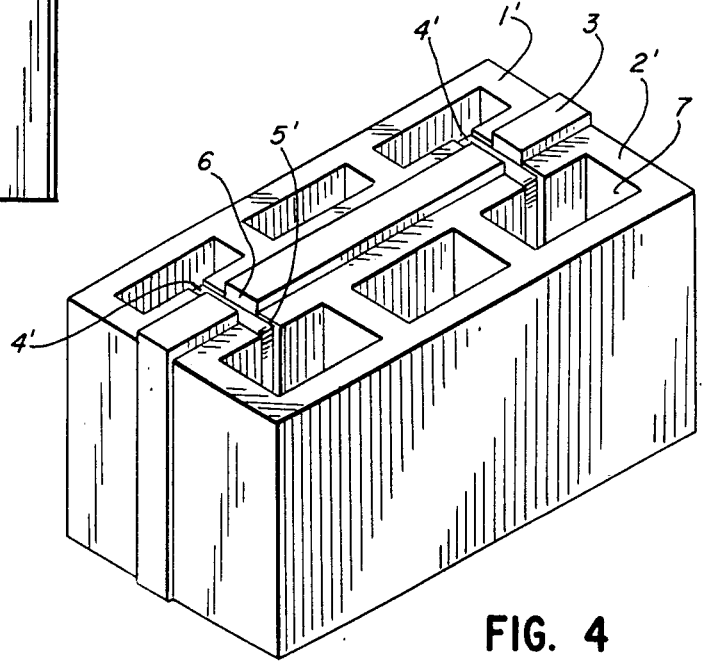
FIG. 4

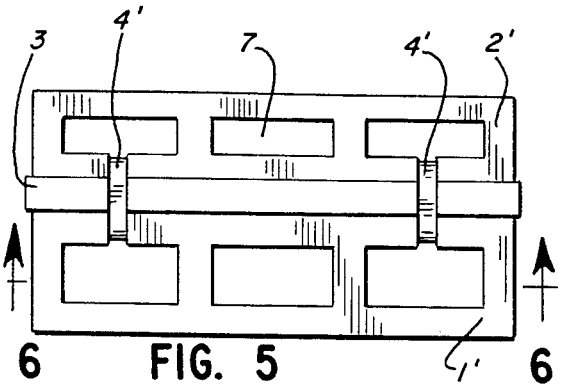
FIG. 5
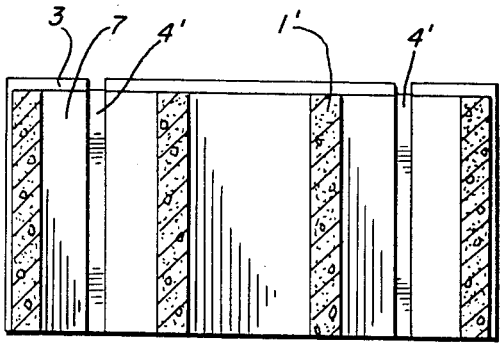
FIG. 6
FIG. 7
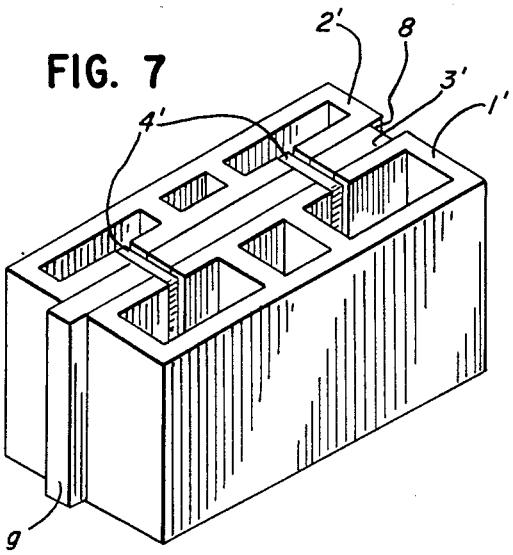
FIG. 8
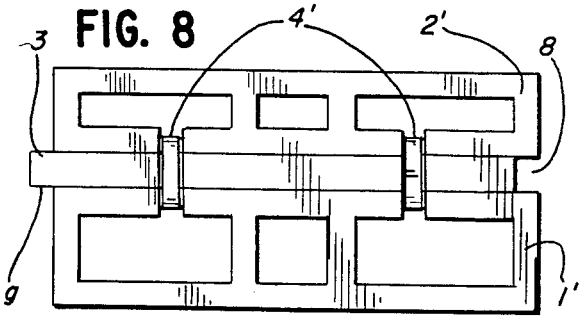
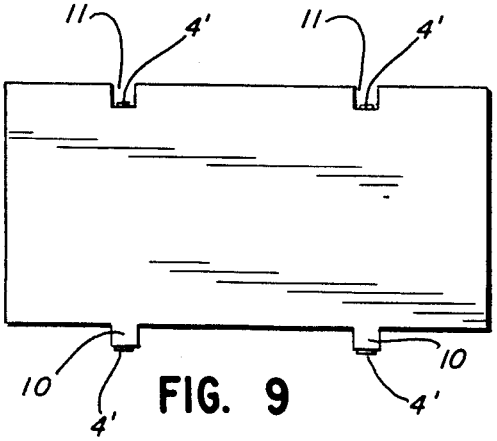
FIG. 9
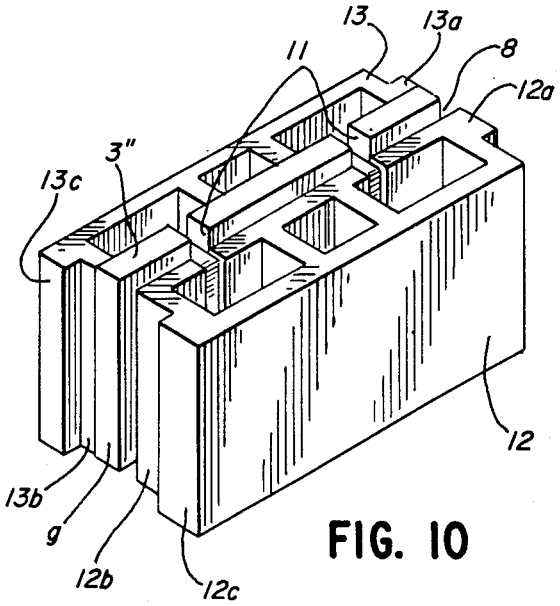
FIG. 10

FIG. 11
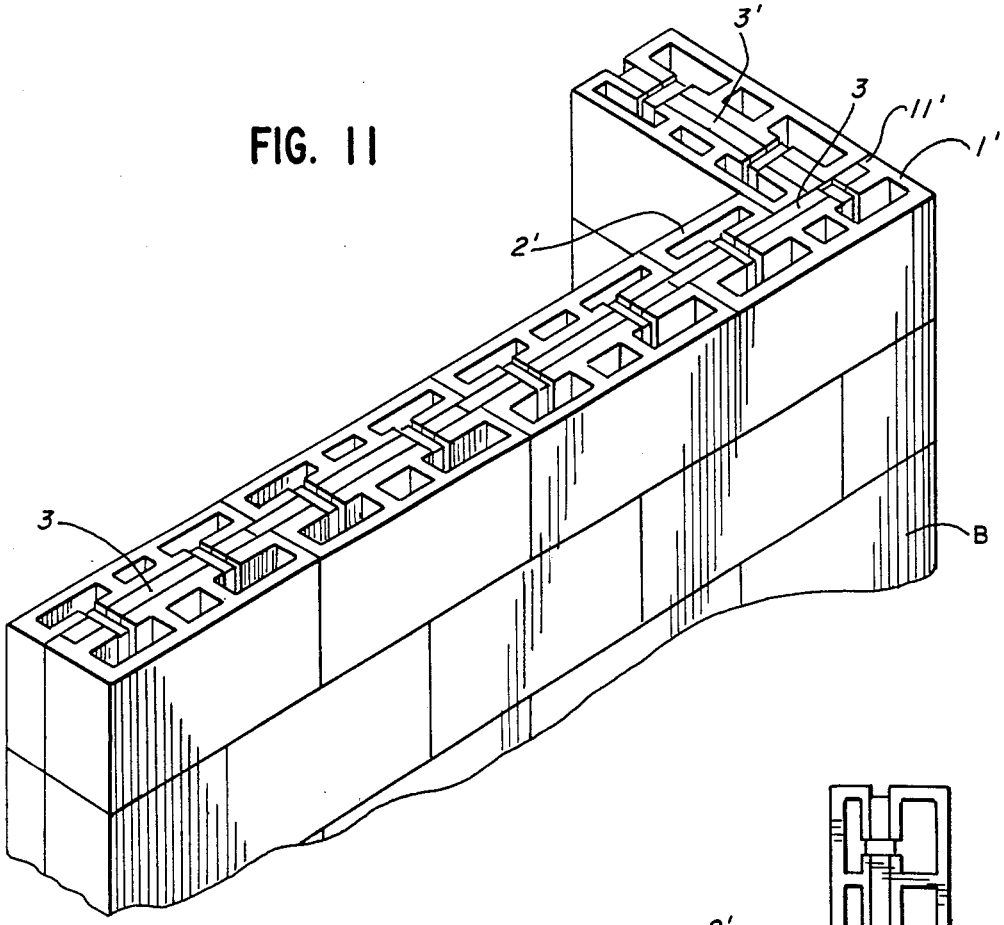
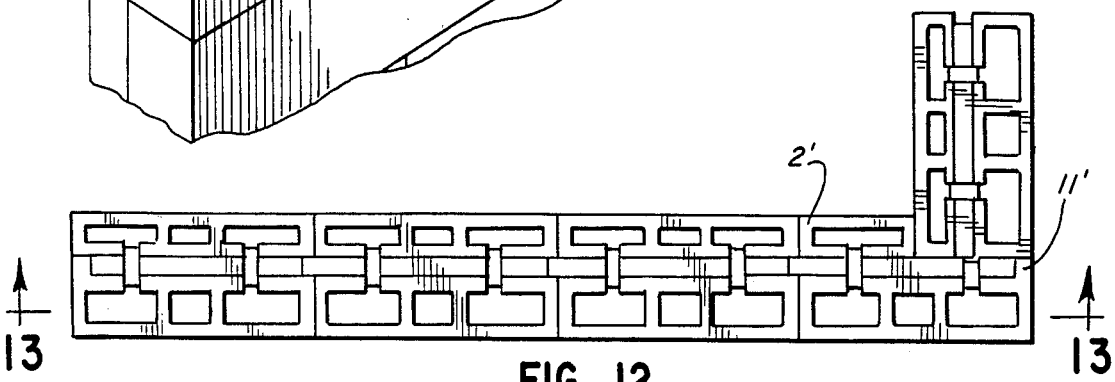
FIG. 12
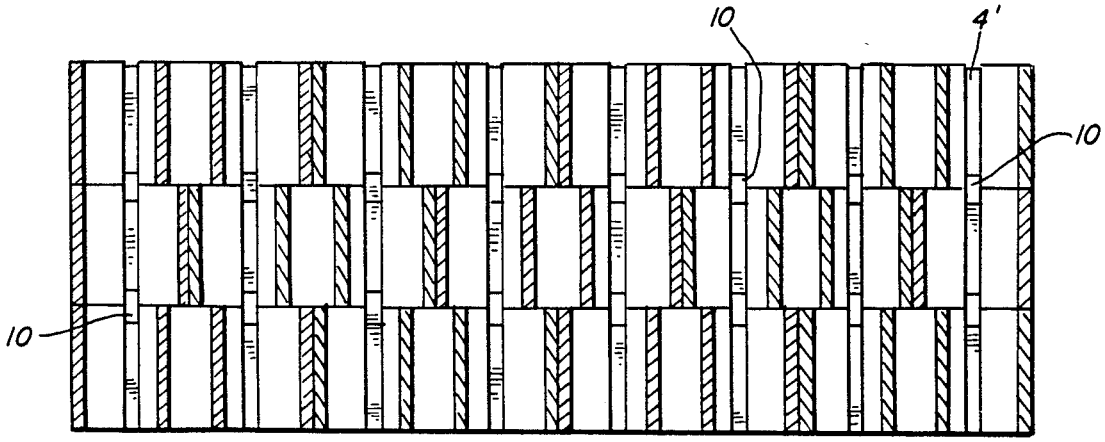
FIG. 13

INSULATING BLOCK UNIT, A METHOD FOR ITS MANUFACTURE, AND A METHOD OF ERECTING A WALL BY MEANS OF SUCH BLOCKS

Numerous patents exist proposing various kinds of insulating blocks. Most of these patents relate to building blocks in which insulating material has been inserted or in which, when a wall is being erected, insulating inserts are provided between adjacent and superposed blocks.

In U.S. Pat. Nos. 3,546,833; 4,148,166; and German Pat. No. 2706714, a building block is described and claimed which incorporates insulating material. These blocks are all of a complicated construction, and the inserts must have special shapes to fit therein. Furthermore, these blocks do not provide a complete circumferential thermal bridge when built into a wall.

U.S. Pat. No. 4,055,928 describes and claims a block made of two shells between which a hollow insulating insert is disposed so that no thermal transfer can take place between the shells. However, such blocks are weak since the shells are held only by thin portions of the insert. Moreover, the entire hollow in the insert has to be filled with concrete making the construction of a wall very expensive.

U.S. Pat. No. 4,016,693 describes a hollow block in which a plate of insulating material is inserted. While this block is extremely simple in construction and therefore cheap in manufacture, a cold bridge exists between adjacent and superposed blocks.

Other blocks are known wherein plugs of insulating material are provided to decrease the thermal transfer. However, all these known blocks are of complicated shape and do not provide a complete thermal insulation between the inside and outside of a wall made of these blocks.

One of the known thermal blocks provides for an insulating plate glued to the side of a building block. This construction limits the use of materials of the building block and insulating plate to such which will be compatible with the glue. The glue is expensive and takes time to dry, increasing the manufacturing time. Furthermore, the blocks must be completely dry before glue can be applied, which prevents manufacture outdoors during rainy weather.

In the context of the present invention, the term "insulating" includes thermally or accoustically insulating and/or having impermeable properties.

It is the object of the present invention to provide a portable and transportable insulating masonry block unit which is of extremely simple construction, inexpensive to manufacture, and useful in conventional construction methods.

It is a further object of the present invention to provide an insulating masonry block unit which can use substantially conventional building blocks of any known material in its manufacture.

It is a further object of the present invention to provide a method of constructing a completely thermally insulating wall made of said masonry block units in which no finishing operations are required and which can be effected by unskilled labour in a quick and efficient manner.

The invention consists in an insulating masonry block unit comprising a sandwich of at least two outer conventional type building blocks and an inner plate of insulating material, the sandwich being held together tightly and permanently by at least one encompassing flexible strap, said strap remaining an integral part of the masonry block unit.

The invention further consists in a method of erecting a wall of such insulating masonry block units wherein, after the bottom layer of such units has been placed, a second layer is disposed on said base layer so that said straps are vertically aligned, whereafter they are sealed to each other.

The building blocks as well as the insulating plate may be made of any suitable material used in the building field. It is preferable to use two blocks having an insulating plate between them. However, three or more building blocks may be used separated from each other by an insulating plate. The building blocks may be conventional ones and may have any suitable shape. They may be of the same thickness or of different thicknesses. They may have one or more throughgoing cavities. The strap may extend through one or more of said cavities or may extend around the periphery of the blocks and insulating plate. The insulating plate may be of any suitable plastics, or any other thermally insulating, accoustically insulating, and/or impermeable material, including material impermeable to X-rays and other radioactivity. For example, the insulating layer may be made of fibers, glass wool, rock wool or lead sheet, among other materials. It may be of one piece or may be made of layers, if desired, each having the same or a different insulating property.

The invention is illustrated by way of example only in the accompanying drawings in which:

FIG. 1 is a perspective view of one embodiment of the thermally insulating masonry block according to the invention;

FIG. 2 is a plan view thereof;

FIG. 3 is an elevation thereof;

FIG. 4 is a perspective view of a second embodiment of the block according to the invention;

FIG. 5 is a plan view of the block of FIG. 4;

FIG. 7 is a still further embodiment of the block according to the invention;

FIG. 8 is a plan view of the block of FIG. 7;

FIG. 9 is an elevation of a further embodiment of an insulating plate;

FIG. 10 is a perspective view of a further embodiment of the building block unit of the invention;

FIG. 11 is a perspective view of a wall built with the blocks according to the present invention;

FIG. 12 is a plan view of the wall of FIG. 11;

FIG. 13 is a vertical section thereof taken on line XIII—XIII of FIG. 12;

Figure 14:
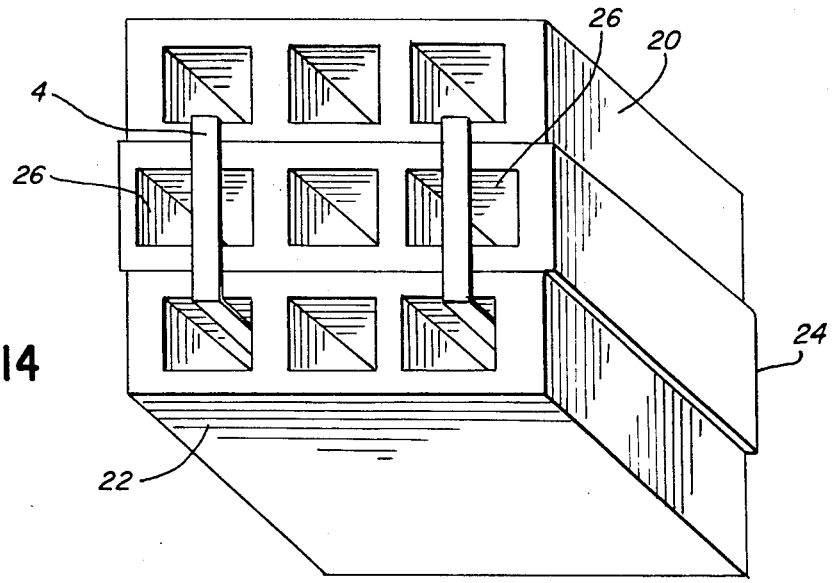
FIG. 14 is a perspective view of a further embodiment of the building block according to the invention.

The insulating masonry block unit shown in FIGS. 1–3 is constituted by two conventional building blocks 1 and 2 between which an insulating plate 3 is disposed. Plate 3 projects slightly from the top of the blocks and from their sides, being flush with the bottom.

The 'sandwich' of the two blocks 1 and 2 and the insulating plate 3 is held together encompassing by two straps 4 which, as shown, are equally spaced from the ends of the blocks and are located in suitable grooves 5 made in the blocks and cutout 6 made in the top of the plate 3.

The blocks 1 and 2 may be solid, if weight and cost considerations permit, or they may have one continuous cavity or any number of suitable cavities. One of the blocks may be solid and the other may have cavities. As shown here, block 1 is thicker than block 2 but they may also be of the same thickness. While two straps 4 have been shown, if desired, only one strap or more than two may be provided, spaced as desired. If desired, groove 5 may be dispensed with. The strap may be of any desired width.

In the block unit shown in FIGS. 4–6, the insulation plate is sandwiched between conventional building blocks 1', 2' which have three vertically through-going cavities 7. The straps 4' extend through the outer cavities 7 and the cutout 6 of plate 3, being disposed in vertical grooves 5', located within cavities 7. Alternatively, the straps 4' extend through cavities 7 and about plate 3 without the addition of cutout 6 or grooves 5'. It is understood that blocks 1' and 2' may be of any suitable shape and may have any suitable number of cavities of any desired cross-section. The blocks may be identical or one block may be different from or thicker than the other, or be of different material than the other, e.g. concrete and/or ceramics, ytong (T.M.) silicate, plastics, metal, or the like. The insulating plate may be of any suitable plastics having any desired property such as thermal and acoustic insulation and/or impermeability. If desired, it can be made of one material, e.g. foam plastics such as polyurethane or polystyrene, or it may be made of laminations or aggregates of suitable materials, such as tarred paper, rock wool, rubber or plastics or the like, cork, separate or together, the particular insulation being chosen according to the building requirements. An additional layer, such as a lead sheet, may also be added if impermeability to radiation is desired. Such blocks are particularly suitable for use in operating rooms, X-ray rooms and buildings housing scientific experiments or industrial processes using radioactive materials.

The straps 4 can be any suitable flexible tying material such as rope, leather, metal or plastic strips, commonly used for baling and tying large cartons.

In FIG. 7 and FIG. 8 the insulating plate 3' is of the same dimensions in length and height as blocks 1' and 2'. It is shifted horizontally relative the latter so that is is receded slightly at one end of the blocks, leaving a space 8 at that end between blocks 1' and 2', and projects for the same distance at the other end 9 of the blocks as shown. Thus, when two block units are juxtaposed, the projection 9 of one block unit will engage the space 8 of the adjacent one.

The 'sandwich' block unit is held together by two straps 4' equally spaced from the end of the blocks.

The block unit illustrated in FIGS. 7 and 8 facilitates the assembly of the blocks into one rigid layer. However, in order to facilitate also the placement of superposed block units, the insulating plate 3'' is made, as shown in FIG. 9, of substantially the same height and length as the blocks, is shifted slightly upwardly relative to the latter and is provided with two leg-like extensions 10 at its bottom and with corresponding cut-outs 11 at its top. As shown in FIG. 10, the blocks, whose particular shape will be described hereinafter, and plate 3'' are assembled so that the latter extends above the top of the blocks for a distance equal to the depth of cut-outs 11, i.e. the bottom of cut-outs 11 is flush with the top of the blocks and straps 4' extend within said cut-outs and around legs 10. Thus, when two layers of assembled blocks are superposed, the legs 10 of superposed block units will engage in cut-outs 11 of the block units of the layer below whereby the stretches of plate 3'' between cut-outs 11 will engage in the spaces between legs 10. It is, of course, understood that one or more than two legs and corresponding cut-outs may be provided.

If the features of the masonry block unit described with reference to FIGS. 7 and 8 and those of FIG. 9 are combined, and proper dimensions between legs 10 and cut-outs 11 are provided, the assembly of a wall which can easily be effected by an unskilled worker attains a stable structure wherein movement of the individual blocks in any direction is prevented.

In known thermal blocks or thermal insulation of buildings, one of the important considerations is the prevention of damage to the insulation. It is obvious from the above description and the drawings that, according to the invention, the blocks 1 and 2 provide means for preventing damage to the insulating plate 3. However, the handling of building blocks in a standard manner for transport is often effected with the aid of hydraulic clamps which may press a layer of the block units so that the insulating plates 3 are damaged at their projecting edges. In order to prevent this and to increase the possibility of immovability of adjacent and superposed block units relative each other, the building blocks may be formed as shown in FIG. 10.

Each block 12, 13 is made integral at one end with a projecting flange **12*a*, 13*a* respectively and at the other with a cut-away portion 12*b*, 13*b*, respectively, the latter being of substantially the same width as flanges 12*a*, 13*a* respectively, and being staggered relative thereto. The shape of insulating plate 3'' is that described with reference to FIG. 9. In this manner the block units may be juxtaposed so that flanges 12*a*, 13*a* of a first unit extend into cut-away portions 12*b*, 13*b* respectively of the adjacent second block unit and projection 9 of the latter extends into space 8 of said first block unit. Furthermore, the portions 12*c*, 13*c* next to cut-away portions 12*b*, 13*b* respectively protect the vertically extending projections 9 of the insulating plate 3''** during transport.

If desired, flanges **12*a*, 13*a* can be of any suitable width, smaller or of different shape than cut-away portions 12*b*, 13*b***. When such block units are juxtaposed, a space may be created between them, but the insulating plates will touch each other.

The insulating plate may also be made shorter on both ends of the blocks to protect the insulating plate during transport of the block units. In this case it will be necessary to insert a piece of insulating plate between two juxtaposed block units in the spaces left by the insulating plate between the blocks.

In FIGS. 11 to 13, a wall is built from the blocks shown in FIGS. 7 and 8. After the base layer B of he blocks is placed in position, and preferably, affixed to the foundation by mortar, as known, a second layer is superimposed in staggered relation in such a manner that straps 4' of the second layer are in vertical alignment with those of the base layer.

The straps of the two layers may be glued, welded, clamped or heat-sealed to each other, depending on the material of which the straps are constituted. It is preferred to make straps 4' of a thermoplastic plastics so that the blocks can be connected to each other by means of short strips 10 which are attached by glue or heatsealing between the top of the straps 4' of the blocks of a lower stretch and the bottom of the straps 4' of the blocks of a superposed stretch at both sides of the assembled blocks. The attachment is effected by means of a suitable forklike clamp from above each layer, which extends through the cavities of the block. The straps of the blocks are thus rigidly attached to each other so that no mortar or the like is required between layers of blocks, and no finishing operations are necessary in the erected wall.

The wall of the present invention may be made by conventional methods, including the use of mortar, with the building blocks of the present invention.

If desired, concrete may be poured into several or all of the cavities of the block unit, as in conventional building construction. Also, if desired, the outsides of the wall may be covered with mortar, likewise as in conventional building methods. However, both these procedures are not necessary, with the block according to the invention, thus providing a less costly building method.

In order to ensure a perfect thermal bridge all around the building, the corner is made in such a manner, as can be seen in FIGS. 11 and 12, that half the length of block 2', which corresponds to the thickness of the standard masonry block according to the invention, is cut off at 11 and a standard block is placed against said cut-off part 11 perpendicular to it, so that plate 3' of one block is in engagement. The side wall of block 1' placed in a corner is provided with an extension 11' in such a manner that it covers the edge of plate 3, i.e. extension 11' fills space 8.

If desired, any other suitable corner construction can be effected which will secure a perfect thermal bridge in the corners.

In general, it can be appreciated that when it is desired to use mortar between layers of block units, the insulating plate has to extend slightly above and beyond the sides of the building blocks to assure a thermal bridge between the layers.

In the case where the straps are connected to each other and no mortar is used, the insulating plates of the units touch each other and form a thermal bridge.

It will be appreciated that the insulating plate in the building block of the present invention need not be a shallow plate. Referring to the embodiment of FIG. 14, there is shown a building block unit constituted by two conventional building blocks 20 and 22 between which an insulating material also in the shape of a building block 24 is disposed. The block of FIG. 14 is useful when it is desired to provide a building block unit of greater than usual width, when the amount of insulation required between blocks is particularly large, and so on. The insulating plate may be formed with cavities 26, as illustrated, in order to save material and make the finished block unit lighter in weight. Cavities 26 can be of any size, shape or number desired. Alternatively, the insulating block may be a solid block of foamed plastic, styrofoam or other insulating material with no cavities.

Figure 15:
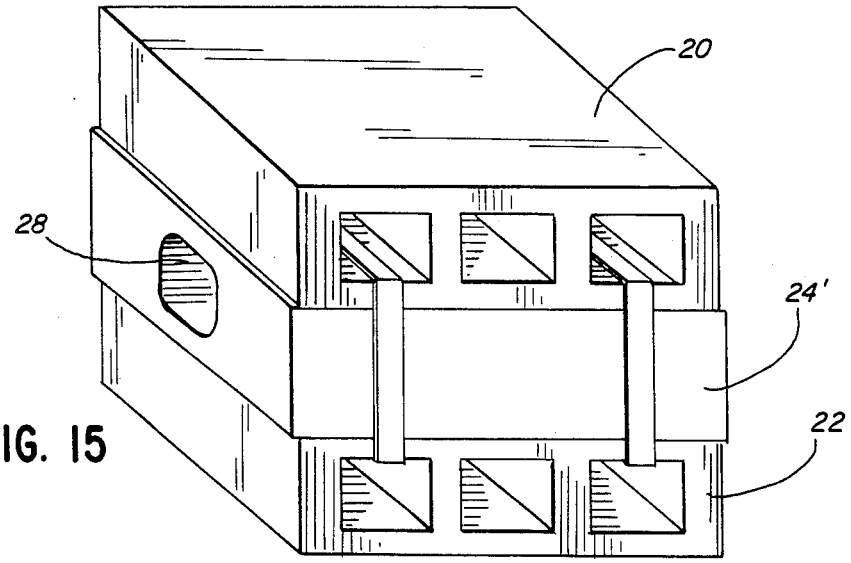
FIG. 15 is a perspective view of an additional embodiment of a building block according to the invention.

With reference to FIG. 15, there is shown an alternate embodiment of the building block of FIG. 14. In this embodiment, the insulating material 24' defines a cavity 28 in a plane perpendicular to the cavities in blocks 20, 22. Cavity 28 permits passage of various pipes, i.e. water, steam, electricity, through the finished wall. In addition, it provides insulation for these pipes, rather than necessitating the addition of insulating materials, as in conventional building blocks.

Figure 16:
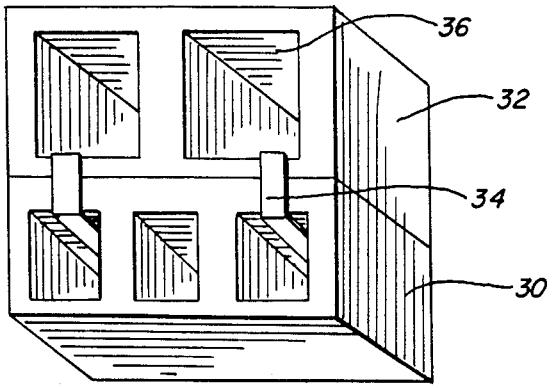
FIG. 16 is a perspective view of a further embodiment of a building block according to the invention.

Referring now to FIG. 16 there is shown an alternate embodiment of the building block of the present invention comprising a single conventional building block 30 and an insulating plate 32 tied together by straps 34. Insulating plate 32 may comprise a plate shaped like a conventional building block, as illustrated, with or without cavities 36, or a narrower plate of any design. The building block of FIG. 16 is particularly useful as a ceiling block or as an insulating wall behind a decorative brick or other wall. Where insulating plate 32 comprises a block of foamed plastic, an additional insulating layer for sound or other insulation can be sandwiched between plate 32 and block 30, as described above.

It will be appreciated by those skilled in the art that the invention is not limited to what has been shown and described hereinabove. Rather, the scope of the invention is limited solely by the claims which follow.

I claim:

1. A hand portable and transportable insulating masonry block unit useful in conventional construction methods comprising a sandwich of an inner plate of insulating material between two conventional type building blocks, each of said building blocks defining two outer faces and at least one through-going cavity parallel to said faces, said sandwich being held together tightly and permanently by a continuous flexible strap looped through at least one through-going cavity of each of said two building blocks and encompassing said insulating material, said continuous strap remaining an integral part of said masonry block unit without protruding from the outer faces thereof.

2. An insulating masonry block unit as defined in claim 1, comprising a thermally insulating inner plate.

3. An insulating masonry block unit as claimed in claim 1, wherein said plate is of such dimensions that it protrudes slightly from the top and at least one side of the building blocks.

4. An insulating masonry block unit as defined in claim 1, wherein notches are made for the straps in the building blocks.

5. A thermally insulating masonry block unit as defined in claim 1, wherein said plae is made of layers, each having the same or different insulating properties.

6. An insulating masonry block unit as defined in claim 1, wherein the building blocks and insulating plate have upper edges and lower edges, and wherein the plate is displaced vertically relative to the building blocks and said plate being provided at its lower edge with integral leg-like extensions and at its upper edge with corresponding cut-outs, the bottom of said extensions and the bottom of said cut-outs being substantially flush with the lower and upper edges respectively, of the building blocks.

7. An insulating masonry block unit as defined in claim 1, wherein said insulating plate defines at least one cavity therethrough.

8. A hand portable and transportable insulating masonry block unit useful in conventional construction methods comprising a sandwich of at least two outer conventional type building blocks and an inner plate of insulating material, the sandwich being held together tightly and permanently by at least one encompassing flexible strap, said strap remaining an integral part of the masonry block unit, wherein notches are provided for the straps in the building blocks.

9. An insulating masonry block unit as defined in claim 8 comprising a thermally insulating inner plate.

10. An insulating masonry block unit as defined in claim 8 wherein the building blocks have at least one through-going cavity, the encompassing strap being looped through said cavity.

11. An insulating masonry block unit as claimed in claim 8 wherein said plate is of such dimensions that it protrudes slightly from the top and at least one side of the building blocks.

12. A thermally insulating masonry block unit as defined in claim 8 wherein said plate is made of layers, each having the same or different insulating properties.

13. An insulating masonry block unit as defined in claim 8 wherein the building blocks and insulating plate have upper edges and lower edges, and wherein the plate is displaced vertically relative to the building blocks and said plate being provided at its lower edge with integral leg-like extensions and at its upper edge with corresponding cut-outs, the bottom of said extensions and the bottom of said cut-outs being substantially flush with the lower and upper edges respectively, of the building blocks.

14. An insulating masonry block unit as defined in claim 8 wherein said insulating plate defines at least one cavity therethrough.

15. A hand portable and transportable insulating masonry block comprising a conventional building block defining two outer faces and at least one through-going cavity parallel to said faces, a plate of insulating material also defining two outer faces and at least one through-going cavity parallel to said faces, one face of said building block being in register with one face of said insulating plate, and a continuous flexible strap, wherein said building block and said insulating plate are held together tightly and permanently by said continuous flexible strap looped through the cavities of said building block and said insulating plate, said strap remaining an integral part of said insulating block without protruding from said outer faces thereof.

* * * * *

UNITED STATES PATENT AND TRADEMARK OFFICE

CERTIFICATE OF CORRECTION

PATENT NO. : 4,802,318

DATED : February 7, 1989

INVENTOR(S) : Jacov Snitovski

It is certified that error appears in the above-identified patent and that said Letters Patent is hereby corrected as shown below:

column 6, line 43, "plae" should be --plate--; and line 64, after the phrase "encompassing flexible strap", insert --forming a closed loop and encircling at least a portion of said conventional type building blocks--.

Signed and Sealed this

Twenty-fifth Day of July, 1989

*Attest:*

*Attesting Officer*

DONALD J. QUIGG

*Commissioner of Patents and Trademarks*